US005666046A

United States Patent [19]

Mietus

[11] Patent Number: 5,666,046

[45] Date of Patent: Sep. 9, 1997

[54] REFERENCE VOLTAGE CIRCUIT HAVING A SUBSTANTIALLY ZERO TEMPERATURE COEFFICIENT

[75] Inventor: David F. Mietus, Phoenix, Ariz.

[73] Assignee: Motorola, Inc., Schaumburg, Ill.

[21] Appl. No.: 518,768

[22] Filed: Aug. 24, 1995

[51] Int. Cl.[6] ..... G05F 3/16

[52] U.S. Cl. ..... 323/313; 323/316; 323/907

[58] Field of Search ..... 323/313, 314, 323/315, 316, 907

[56] References Cited

U.S. PATENT DOCUMENTS

| | | | |
|---|---|---|---|
| Re. 30,586 | 4/1981 | Brokaw | 323/314 |
| 3,887,863 | 6/1975 | Brokaw | 323/314 |
| 4,061,959 | 12/1977 | Ahmed | 323/313 |
| 4,368,420 | 1/1983 | Kuo | 323/907 |
| 4,419,594 | 12/1983 | Gemmell et al. | 323/315 |
| 4,472,675 | 9/1984 | Shinomiya | 323/314 |
| 4,587,478 | 5/1986 | Kasperkovitz et al. | 323/316 |
| 4,590,419 | 5/1986 | Moriarty | 323/907 |
| 4,626,770 | 12/1986 | Price | 323/313 |
| 4,896,094 | 1/1990 | Greaves et la. | 323/314 |
| 5,029,295 | 7/1991 | Bennet et al. | 323/313 |
| 5,061,862 | 10/1991 | Tamagawa | 323/316 |
| 5,081,410 | 1/1992 | Wood | 323/316 |
| 5,087,830 | 2/1992 | Cave et al. | 323/314 |
| 5,153,500 | 10/1992 | Yamamoto et al. | 323/314 |
| 5,168,210 | 12/1992 | Thus | 323/313 |
| 5,245,273 | 9/1993 | Greaves et al. | 323/315 |
| 5,384,740 | 1/1995 | Etoh et al. | 323/313 |
| 5,528,128 | 6/1996 | Melse | 323/315 |

OTHER PUBLICATIONS

Bang-Sup Song and Paul R. Gray, IEEE Journal of Solid-State Circuits,"A Precision Curvature-Compensated CMOS Bandgap Reference", Dec. 1983, vol. SC-18, No. 6, pp. 634-643.

Marc Degrauwe et al., IEEE Journal of Solid-State Circuits, "CMOS Voltage References Using Lateral Bipolar Transistors", Dec. 1985, vol. SC-20, No. 6, pp. 1151-1157.

Bhupendra K. Ahuja et al., IEEE Journal of Solid-State Circuits,"A Programmable CMOS Dual Channel Interface Processor for Telecommunications Applications", Dec. 1984, vol. SC-19, No. 6, pp. 892-898.

Eric A. Vittoz and Olivier Neyroud, IEEE Journal of Solid-State Circuits,"A Low-Voltage CMOS Bandgap Reference", Jun. 1979, vol. SC-14, No. 3, pp. 573-577.

Marco Ferro et al., IEEE Journal of Solid-State Circuits,"A Floating CMOS Bandgap Voltage References for Differential Applications", Jun. 1989, vol. 24, No. 3, pp. 690-697.

Robert A. Blauschild et al., IEEE Journal of Solid-State Circuits, "A New NMOS Temperature-Stable Voltage Reference", Dec. 1978, vol. SC-13, No. 6, pp. 767-773.

A. Paul Brokaw, IEEE Journal of Solid-State Circuits, "A Simple Three-Terminal IC Bandgap Reference", Dec. 1974, vol. SC-9, No. 6, pp. 388-393.

Paul R. Gray and Robert D. Meyer, Dec. 1984, Analysis and Design of Analog Integrated Circuits, Second Edition, pp. 736-737.

*Primary Examiner*—Jeffrey L. Sterrett
*Attorney, Agent, or Firm*—Rennie William Dover

[57] ABSTRACT

A method for generating a programmable bandgap output reference voltage ($V_{REF31}$) and a voltage reference circuit (31) have been provided. The voltage reference circuit (31) includes a pair of bipolar transistors (33, 34), a resistor (36), an operational amplifier (32) and a plurality of field effect transistors (38, 39, 41) configured to generate a current ($I_1'$) having a positive temperature coefficient. In addition, the voltage reference circuit (31) includes a resistor (46), an operational amplifier (44), another plurality of field effect transistors (47, 48) which, in conjunction with one (34) of the pair of bipolar transistors, generates a current ($I_2'$) having a negative temperature coefficient. The current ($I_1'$) having the positive temperature coefficient is summed with the current ($I_2'$) having the negative temperature coefficient to form a current having a zero temperature coefficient, which is used to develop a voltage having a zero temperature coefficient.

22 Claims, 2 Drawing Sheets

FIG. 1
(PRIOR ART)
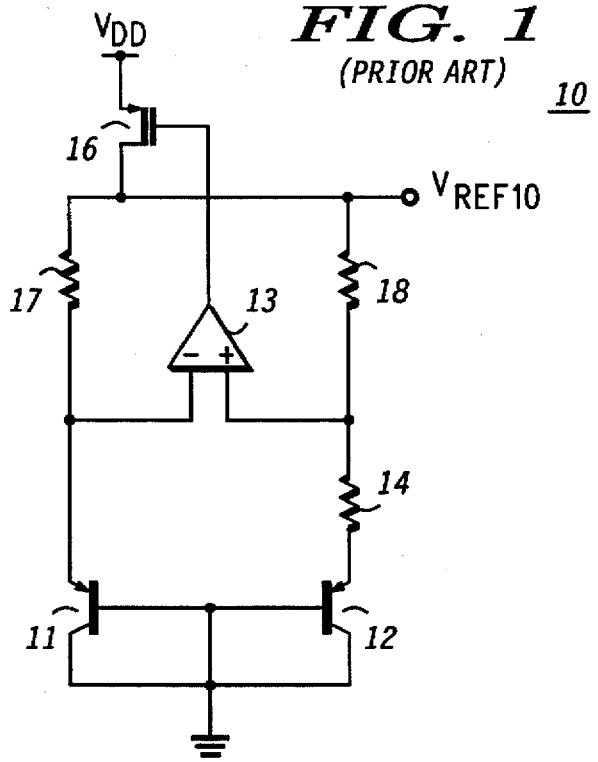
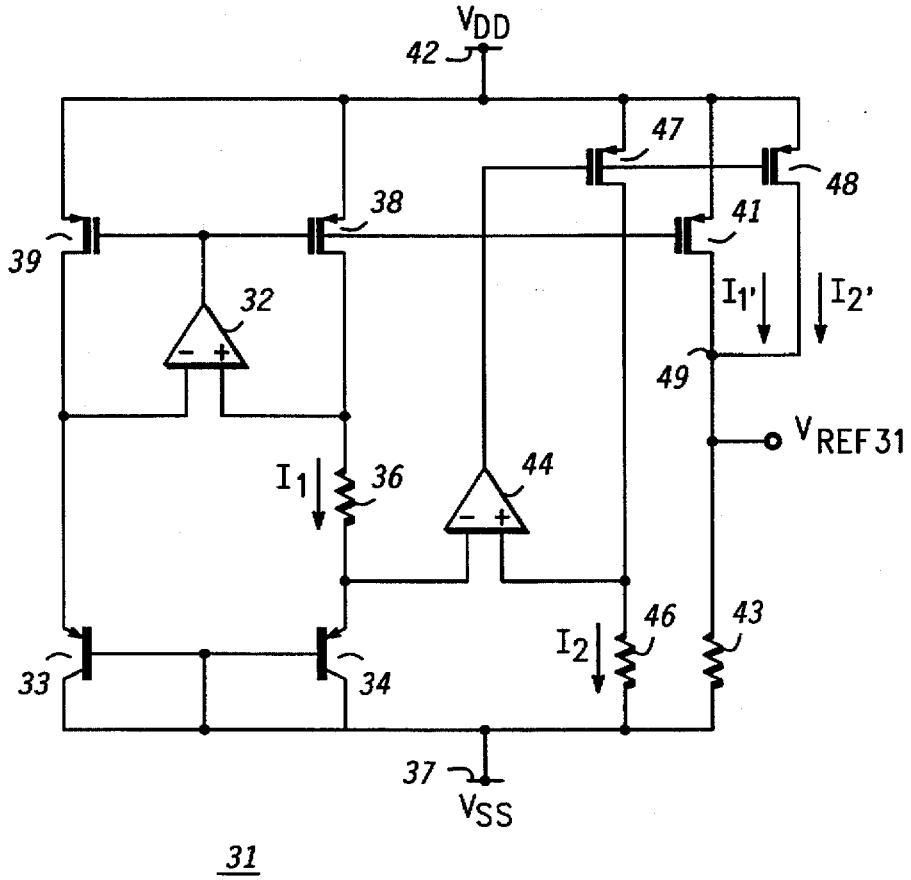
FIG. 2

REFERENCE VOLTAGE CIRCUIT HAVING A SUBSTANTIALLY ZERO TEMPERATURE COEFFICIENT

BACKGROUND OF THE INVENTION

The present invention relates, in general, to reference voltage circuits, and more particularly, to bandgap reference voltage circuits.

A bandgap reference voltage circuit provides a temperature and supply independent output reference voltage in analog integrated circuits such as filters, analog-to-digital converters, and digital-to-analog converters. The reference voltage is generated by weighting a voltage having a positive temperature coefficient and weighting a voltage having a negative temperature coefficient such that the sum of the two voltages is the reference voltage having a zero temperature coefficient. A common technique for generating the voltage having the positive temperature coefficient is to operate two bipolar transistors at different current densities, thereby generating a delta base-to-emitter voltage ($\Delta V_{BE}$) having a positive temperature coefficient. The voltage having the negative temperature coefficient is generated from the $V_{BE}$ voltage of a third bipolar transistor. As those skilled in the art are aware, a $V_{BE}$ voltage inherently has a negative temperature coefficient. Generation of voltages having positive and negative temperature coefficients is further described in U.S. Pat. No. 3,887,863, titled "SOLID-STATE REGULATED VOLTAGE SUPPLY" and issued to Brokaw on Jun. 3, 1975, and which is hereby incorporated herein by reference.

A drawback of prior art bandgap reference circuits is that their output voltage levels are dependent upon the weighting factors that provide a zero temperature coefficient output reference voltage. In addition, the prior art bandgap reference circuits require a supply voltage of at least 1.5 volts, which may be unsuitable for low power circuit applications.

Accordingly, it would be advantageous to have a method and a means for generating a programmable bandgap output reference voltage. It would be of further advantage to have a bandgap reference circuit capable of operating with a supply voltage of less than 1.5 volts.

BRIEF DESCRIPTION OF THE DRAWINGS

FIG. 1 is a schematic diagram of a prior art bandgap reference circuit;

FIG. 2 is a schematic diagram of a bandgap reference circuit in accordance with an embodiment of the present invention.

DETAILED DESCRIPTION OF THE DRAWINGS

Figure 3:
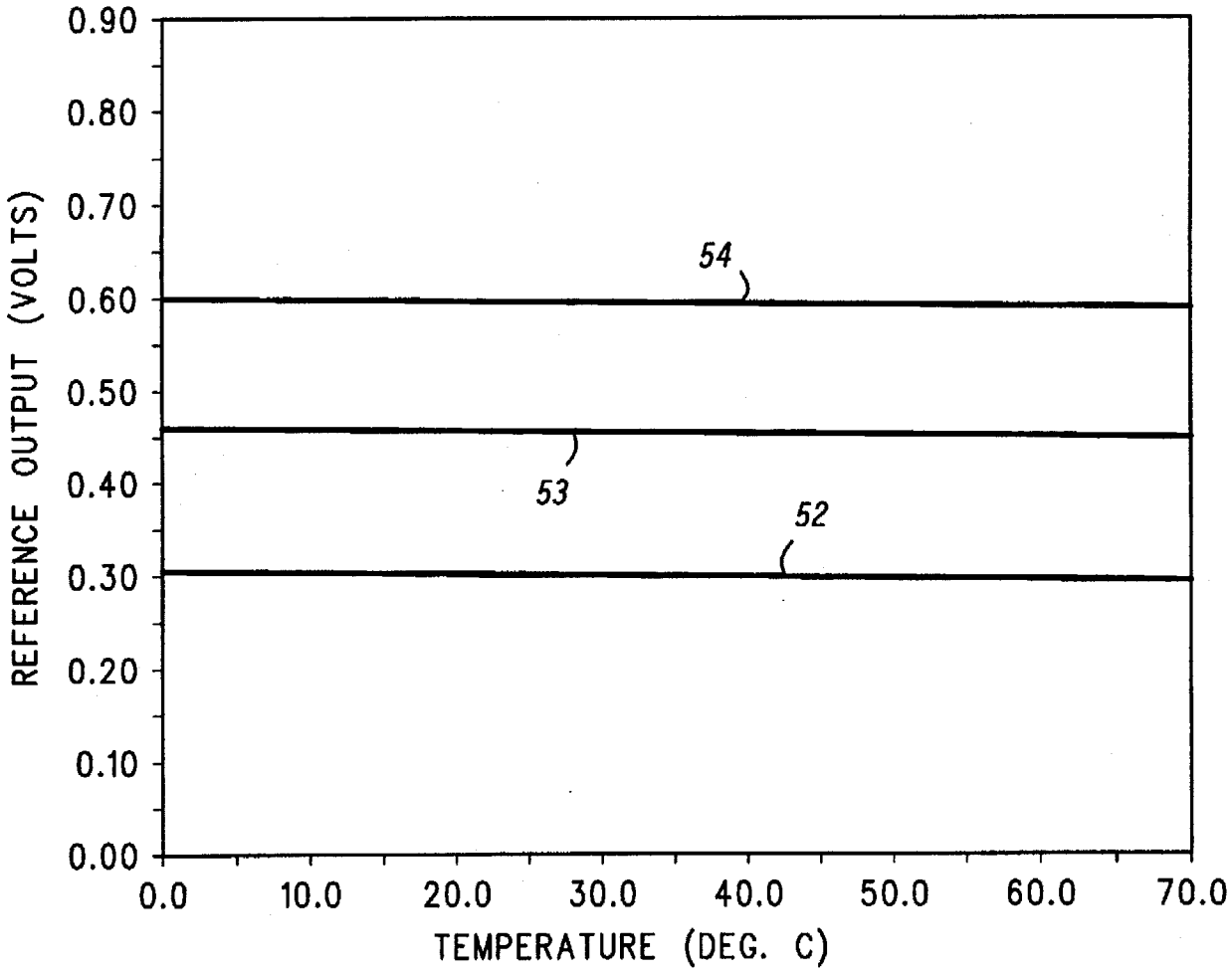
FIG. 3 is a plot illustrating the relationship between an output reference voltage over a range of temperatures for the circuit of FIG. 2.

Generally, the present invention provides a method and a means for generating a programmable bandgap output reference voltage. More particularly, the bandgap output reference voltage level and the zero temperature coefficient output voltage may be set or programmed independently of each other. Further, the bandgap reference voltage circuit of the present invention is capable of operating at a supply voltage as low as the sum of a $V_{BE}$ voltage of a bipolar transistor and a drain-to-source voltage ($V_{DS}$) of a field effect transistor (FET). For example for a $V_{BE}$ voltage of 0.7 volts and a $V_{DS}$ voltage of 0.1 volts the circuit can operate using a supply voltage of 0.8 volts.

FIG. 1 is a schematic diagram of a prior art voltage reference circuit 10 for providing an output reference voltage $V_{REF10}$ which is substantially independent of temperature variations. Voltage reference circuit 10 includes a pair of PNP bipolar transistors 11 and 12 which have their collector and base electrodes connected in a diode configuration. The diode connected collector-base electrodes of transistor 11 are connected to the diode connected collector-base electrodes of transistor 12, as well as to a ground potential. An emitter electrode of transistor 11 is directly connected to an inverting input of an amplifier 13, whereas an emitter electrode of transistor 12 is coupled to a non-inverting input of amplifier 13 via a resistor 14. It should be noted that the inverting input of amplifier 13 is designated by a "–" sign and the non-inverting input of amplifier 13 is designated by a "+" sign. An output terminal of amplifier 13 is connected to a gate of a p-channel FET 16. A drain electrode of p-channel FET 16 is coupled to the inverting input terminal of amplifier 13 via a resistor 17 and to the non-inverting input terminal of amplifier 13 via a resistor 18. Resistors 17 and 18 are designed to be of equal value so that the emitter current of PNP bipolar transistor 11 matches that of PNP bipolar transistor 12. The source electrode of p-channel FET 16 is connected to a supply voltage, $V_{DD}$, greater than 1.5 volts.

It should be understood that an appropriate start-up circuit is typically used to start the circuit at the proper operating point. Start-up circuits are further described in U.S. Pat. No. 5,087,830, titled "START CIRCUIT FOR A BANDGAP REFERENCE CELL" issued to Cave et al. on Feb. 11, 1992, and assigned to Motorola, Inc.

As those skilled in the art are aware, the output reference voltage, i.e., $V_{REF10}$, of circuit 10 is given by:

$$V_{REF10} = \left(\frac{k*T}{q}\right)*n*ln(p) + V_{BE11} \qquad \text{(EQT. 1)}$$

where:

p=ratio the emitter area of transistor 12 to the emitter area of transistor 11;

n=the ratio of the resistance of resistor 18 to the resistance of resistor 14;

T=absolute temperature;

k=Boltzman's constant;

q=the charge of an electron; and $V_{BE11}$=the base emitter voltage for transistor 11.

The temperature characteristics of the reference output voltage are derived by taking the derivative of the output reference voltage, $V_{REF10}$, with respect to temperature, i.e., the derivative of EQT. 1 with respect to temperature. Thus, the temperature characteristics are given by:

$$\frac{dV_{REF10}}{dT} = \left(\frac{V_T}{T}\right)*(n)*ln(p)* + \frac{d(V_{BE11})}{dT} \qquad \text{(EQT. 2)}$$

where $V_T$ is the thermal voltage given as k*T/q.

As those skilled in the art are aware, the temperature coefficient of a bipolar transistor's base-to-emitter voltage, $V_{BE}$, is negative, whereas the temperature coefficient of the ratio $V_T/T$ is positive. Thus, a zero temperature coefficient output reference voltage can be achieved by weighting the values of $d(V_{BE})/dT$ and $V_T/T$ such that their sum is zero. In other words, the values of the constants "n" and "p" are selected to produce a zero temperature coefficient output reference voltage. It should be noted, however, that the value of the output reference voltage is limited by the values of "n" and "p" that are selected to produce an output voltage having a zero temperature coefficient. In other words, the value of the output voltage can not be set independently of a zero temperature coefficient output voltage. Further, circuit 10 is constrained to operate with a minimum power supply voltage of 1.5 volts.

FIG. 2 is a schematic diagram of a voltage reference circuit 31 in accordance with an embodiment of the present invention which is suitable for manufacture using semiconductor processing techniques. Voltage reference circuit 31 includes an operational amplifier 32 having an inverting input, designated by a "–" sign, a non-inverting input, designated by a "+" sign, and an output. An emitter of a PNP bipolar transistor 33 is connected to the inverting input of operational amplifier 32. A base of PNP bipolar transistor 33 is connected to a base of a PNP bipolar transistor 34 and to the collectors of PNP bipolar transistors 33 and 34. In other words, PNP bipolar transistors 33 and 34 are connected in a diode configuration, wherein the anodes are common and formed by the common connection of the respective bases and collectors. The bases and collectors of PNP bipolar transistors 33 and 34 are connected to a power supply electrode 37, which typically operates at a power supply voltage $V_{SS}$. By way of example, $V_{SS}$ is ground potential. An emitter of PNP bipolar transistor 34 is coupled to the non-inverting input terminal of operational amplifier 32 via a resistor 36 and serves as a cathode of diode connected transistor 34. Likewise, the emitter of diode connected PNP bipolar transistor 33 serves as its cathode. The node between the cathode of diode connected transistor 34 and resistor 36 serves as a reference node. The emitter area, $A_{34}$, of PNP bipolar transistor 34 is scaled relative to the emitter area, $A_{33}$, of PNP bipolar transistor 33, wherein the scaling factor is designated by the variable "x". In other words, the relationship between the emitter areas of PNP bipolar transistors 33 and 34 is given by:

$$A_{34}=x*A_{33} \quad \text{(EQT. 3).}$$

In addition, the non-inverting input of operational amplifier 32 is connected to a drain of a p-channel FET 38. Likewise, the inverting input of operational amplifier 32 is connected to a drain of a p-channel FET 39. The output of operational amplifier 32 is connected to the gates of p-channel FETs 38 and 39 as well as to the gate of a p-channel FET 41. The sources of p-channel FETs 38, 39, and 41 are connected to a power supply electrode 42, which typically operates at a power supply voltage $V_{DD}$. A drain of p-channel FET 41 is coupled to power supply conductor 37 via a resistor 43. The dimensions of p-channel FET 41, i.e., the width-to-length ratio, $(W/L)_{41}$, are scaled relative to the dimensions, of p-channel FETs 38 and 39,$(W/L)_{38,39}$, wherein the scaling factor is designated by the variable "m". In other words, the relationship between the dimensions of p-channel FETs 38, 39, and 41 are given by:

$$\left(\frac{W}{L}\right)_{41}=m*\left(\frac{W}{L}\right)_{38,39}. \quad \text{(EQT. 4)}$$

It should be noted that operational amplifier 32, PNP bipolar transistors 33 and 34, resistor 36, and p-channel FETs 38, 39, and 41 cooperate to form an amplifier circuit for generating a current having a positive temperature coefficient. Further, operational amplifier 32, PNP bipolar transistors 33 and 34, and resistor 36 cooperate to form a delta voltage generating circuit.

Voltage reference circuit 31 further includes an operational amplifier 44 having an inverting input, designated by the "–" sign, a non-inverting input, designated by the "+" sign, and an output. The inverting input of operational amplifier 44 is connected to the emitter of PNP bipolar transistor 34. The non-inverting input of operational amplifier 44 is coupled to power supply conductor 37 via a resistor 46 and directly connected to a drain of a p-channel FET 47. The output of operational amplifier 44 is connected to a gate of p-channel FET 47 and to a gate of a p-channel FET 48. The sources of p-channel FETs 47 and 48 are connected to power supply conductor 42. The drain of p-channel FET 48 is connected to the drain of p-channel FET 41 to form a common electrode. The dimensions of p-channel FET 48, i.e., the width-to-length ratio, $(W/L)_{48}$, are scaled relative to the dimensions, of p-channel FET 47,$(W/L)_{47}$, wherein the scaling factor is designated by the variable "y". In other words, the relationship between the dimensions of p-channel FETs 47 and 48 are given by:

$$\left(\frac{W}{L}\right)_{48}=y*\left(\frac{W}{L}\right)_{47}. \quad \text{(EQT. 5)}$$

Since the drains of p-channel FETs 41 and 48 are connected to resistor 43, resistor 43 serves as a summing circuit. It should be noted that the dimensions for p-channel FET 47 are preferably the same as those for p-channel FETs 38 and 39. It should be further noted that operational amplifier 44, PNP bipolar transistor 34, p-channel FETs 47 and 48, and resistor 46 cooperate to form an amplifier circuit for generating a current having a negative temperature coefficient. Thus, PNP bipolar transistor 34 is common to the first and second amplifier circuits.

Although, transistors 33 and 34 are shown as PNP bipolar transistors, it should be understood that this is not a limitation of the present invention. In other words, transistors 33 and 34 can be a set of like NPN bipolar transistors, n-channel field effect transistors, p-channel field effect transistors, or the like. Likewise, transistors 38, 39, 41, 47, and 48 are not limited to p-channel field effect transistors but may be n-channel field effect transistors, PNP bipolar transistors, NPN bipolar transistors, and the like. However, as those skilled in the art are aware, additional circuitry is required when NPN bipolar transistors or n-channel field effect transistors are used for current mirror transistors 38, 39, 41, 47, and 48.

It should be further understood that an appropriate start-up circuit is typically used to start the circuit at the proper operating point. Although the start-up circuit is not shown, the type of start-up circuit is not a limitation of the present invention. It should be noted that start-up circuits were discussed with reference to FIG. 1. Further an optional unity gain buffer circuit (not shown) may be coupled to the output $V_{REF31}$ to provide a buffered output.

In operation, operational amplifier 32 and p-channel FETs 38, 39, and 41 form a current mirror, wherein the drain of p-channel FET 38 serves as a reference current electrode and the drain of p-channel FET 41 serves as an output current electrode. The output of operational amplifier 32 serves as a control node for the current mirror. Thus, the current flowing in the drain of p-channel FET 38 serves as a reference current $I_1$ and the current flowing in the drain of p-channel FET 41 serves as an output current $I_1'$. Since the dimensions of p-channel FETs 38 and 41 are scaled relative to each other by the scaling factor "m", the output current $I_1'$ is scaled relative to the reference current $I_1$ by the scaling factor "m". Thus, the output current $I_1'$ is distinguished from the reference current $I_1$ by a prime (′). The currents $I_1$ and $I_1'$ are equal when "m" equals one. The value of reference current $I_1$ is determined using Kirchoff's voltage law and the virtual ground appearing across the inputs of operational amplifier 32. Thus, the current flowing in the series combination of the resistor 36 and the emitter of PNP bipolar transistor 34 equals the reference current $I_1$, and is given by:

$$I_1 = \frac{\Delta V_{BE}}{R36} \quad \text{(EQT. 6)}$$

where:

$\Delta V_{BE} = V_{BE33} - V_{BE34}$; and

R36=resistance of resistor 36.

It should be understood that since the current flowing into an input of an operational amplifier is negligible, the current flowing in the drain of p-channel FET 38 is equal to current $I_1$. Current $I_1$ generates a source-gate voltage in p-channel FET 38 which also appears across the source and gate of p-channel FET 39. Thus, the current $I_1$ also flows in the drain of p-channel FET 39 and in the emitter of PNP bipolar transistor 33. It should be noted that the drain of p-channel FET 39 serves as a feedback electrode. However, the current densities flowing in the emitters of PNP bipolar transistors 33 and 34 are different because their areas are different. As those skilled in the art are aware, for two bipolar transistors fabricated in near proximity to each other that operate at the same emitter current, the difference in their base-to-emitter voltage, i.e., $\Delta V_{BE}$, is given by:

$$\Delta V_{BE} = \left(\frac{k*T}{q}\right) * 1n(x) \quad \text{(EQT. 7)}$$

where:

T=absolute temperature;

k=Boltzman's constant;

q=the charge of an electron; and x=the ratio of the transistor emitter areas, $A_{34}/A_{33}$.

Thus, the current $I_1$ is given by:

$$I_1 = \frac{\left(\frac{k*T}{q}\right) * 1n(x)}{R36}. \quad \text{(EQT. 8)}$$

The current $I_1'$ is given by:

$$I_1' = \frac{m*\left(\frac{k*T}{q}\right) * 1n(x)}{R36}. \quad \text{(EQT. 9)}$$

Thus, the currents $I_1$ and $I_1'$ are linear functions of absolute temperature with positive temperature coefficients.

Operational amplifier 44 and p-channel FETs 47 and 48 form a current mirror, wherein the drain of p-channel FET 47 serves as a reference current electrode and the drain of p-channel FET 48 serves as an output current electrode. The output of operational amplifier 44 serves as a control node for the current mirror. Thus, the current flowing in the drain of p-channel FET 47 serves as a reference current $I_2$ and the current flowing in the drain of p-channel FET 48 serves as an output current $I_2'$. Since the dimensions of p-channel FETs 47 and 48 are scaled relative to each other by the scaling factor "y", the output current $I_2'$ is scaled relative to the reference current $I_2$ by the scaling factor "y". Thus, the output current $I_2'$ is distinguished from the reference current $I_2$ by a prime (').

The currents $I_2$ and $I_2'$ are equal when "y" equals one. The value of reference current $I_2$ is determined using Kirchoff's voltage law and the virtual ground appearing across the inputs of operational amplifier 44. Thus, the current flowing in resistor 46 equals the reference current $I_2$, and is given by:

$$I_2 = \frac{V_{BE34}}{R46} \quad \text{(EQT. 10)}$$

where R46 equals the resistance of resistor 46.

The current $I_2'$ is given by:

$$I_2' = y*\frac{V_{BE34}}{R46}. \quad \text{(EQT. 11)}$$

Again, the current flowing into an input of an operational amplifier is negligible, thus the current $I_2$ is equal to the current flowing in the drain of p-channel FET 47. Since the currents $I_2$ and $I_2'$ are dependent on the base-to-emitter voltage $V_{BE34}$, they have negative temperature coefficients.

The currents $I_1'$ and $I_2'$ are summed at node 49 and flow through resistor 43 to generate an output reference voltage $V_{REF31}$ which is given by:

$$V_{REF31} = R43*\left[\frac{m*\left(\frac{k*T}{q}\right)*1n(x)}{R36} + \frac{y*V_{BE34}}{R46}\right]. \quad \text{(EQT. 12)}$$

The resistance value of resistor 36 can be scaled relative to the resistance value of resistor 46, wherein the scaling factor is designated by the variable "n". In other words, the relationship between the resistance values of resistors 36 and 46 are given by:

$$R36 = n*R46 \quad \text{(EQT. 13).}$$

Rearranging EQT. 12 and substituting for R36 yields:

$$V_{REF31} = \left(\frac{R43}{R46}\right)*\left[\frac{\left(\frac{k*T}{q}\right)*(m)*1n(x)}{n} + y*V_{BE34}\right]. \quad \text{(EQT. 14)}$$

The temperature characteristics of the output reference voltage $V_{REF31}$ are derived by taking the derivative of EQT. 14 with respect to temperature. Thus the temperature characteristics of output reference voltage circuit 31 are given by:

$$\frac{dV_{REF31}}{dT} = \left(\frac{R43}{R46}\right)*\left[\frac{\left(\frac{V_T}{T}\right)*(m)*1n(x)}{n} + y*\frac{d(V_{BE34})}{dT}\right] \quad \text{(EQT. 15)}$$

where $V_T$ is the thermal voltage given as k*T/q.

Thus, the output reference voltage $V_{REF31}$ can be set to a desired level independently of being set for a zero temperature coefficient. In other words, the temperature coefficient of the output reference voltage can be set to be zero by the selection of the values of the variables "x", "n", "m", and "y", whereas the actual level of $V_{REF31}$ can be set by the selection of the values of the resistors 43 and 46. It should be understood that any desired temperature coefficient can be achieved by the selection of the values of the variables "x", "n", "m", and "y".

FIG. 3 is a plot 51 illustrating the relationship between output reference voltage, $V_{REF31}$, and temperature coefficient, TC, over a range of temperatures for circuit 31. The output voltage can be set to a desired level and to a zero temperature coefficient and maintained at that level over a large temperature range. For example, selecting the component values so that $V_{REF31}$ is approximately 0.31 volts at 27° C. yields a temperature coefficient of approximately 0 parts per million per °C. (ppm/°C.). Thus, $V_{REF31}$ remains constant over the temperature range from 0° C. to 70° C., i.e., $V_{REF31}$ has a substantially zero temperature coefficient. Selecting the component values so that $V_{REF31}$ is approximately 0.46 volts at 27° C. yields a temperature coefficient of approximately 0 ppm/°C. Selecting the component values so that $V_{REF31}$ is approximately 0.60 volts at 27° C. yields a temperature coefficient of approximately 0 ppm/°C. It should be noted that for the plot of FIG. 3, the value of the variable "x" has been set to 11, the value of the variables "m" and "y" have been set to one, the value of the variable "n" has been set to 9, and the value of resistor 46 has been set to 6.6 kilo-ohms (kΩ). Curves 52, 53, and 54 were generated for resistor 46 having values of 14.85 kΩ, 22.275 kΩ, and 29.7 kΩ, respectively. Since the value of the variable "x" is greater than one, PNP bipolar transistor 34 has a larger emitter area than PNP bipolar transistor 33. Although, the value of the variable "m" is set to one, it should be noted that its value can be increased by setting the width-to-length ratios of p-channel field effect transistors 38 and 39 to be equal and setting the width-to-length ratio of p-channel field effect transistor 41 to be larger than the width-to-length ratios of p-channel field effect transistors 38 and 39.

By now it should be appreciated that a method and a means for generating a programmable output reference voltage having a zero temperature coefficient has been provided. The output reference voltage can be adjusted independently of being set to have a zero temperature coefficient. Further, the circuit can be operated from a supply voltage as low as the sum of a base-to-emitter voltage and a drain-to-source voltage.

I claim:

1. A reference voltage circuit, comprising:

a first amplifier circuit for generating a current having a positive temperature coefficient, the first amplifier circuit including a delta voltage generating circuit and having an output;

a second amplifier circuit for generating a current having a negative temperature coefficient, a portion of the delta voltage generating circuit common to the second amplifier circuit, the second amplifier circuit having an output, wherein the outputs of the first and second amplifier circuits are coupled to form a common electrode; and a summing circuit coupled to the common electrode.

2. The reference voltage circuit of claim 1, wherein the delta voltage generating circuit comprises first and second diode connected transistors and a resistor, the first and second diode connected transistors each having an anode and a cathode, wherein the anodes of the first and second diode connected transistors are coupled together and to a first power supply electrode, and the resistor is coupled to the cathode of the first diode connected transistor, and wherein the first diode connected transistor serves as the portion of the delta voltage generating circuit common to the second amplifier circuit.

3. The reference voltage circuit of claim 2, wherein the first and second diode connected transistors are a set of like transistors selected from the group consisting of PNP bipolar transistors, NPN bipolar transistors, n-channel field effect transistors, and p-channel field effect transistors.

4. The reference voltage circuit of claim 2, wherein the first amplifier circuit further includes an operational amplifier having first and second inputs and an output, the first input coupled to the resistor and the second input coupled to the cathode of the second diode connected transistor.

5. The reference voltage circuit of claim 4, wherein the first amplifier circuit further includes a first current mirror having first and second current conductors, the first current conductor coupled to the first input of the operational amplifier and the second current conductor serving as the output of the first amplifier circuit.

6. The reference voltage circuit of claim 5, wherein the second amplifier circuit includes an operational amplifier having first and second inputs and an output, the first input of the operational amplifier of the second amplifier circuit coupled to the cathode of the first diode connected transistor.

7. The reference voltage circuit of claim 6, wherein the second amplifier circuit further includes a resistor having first and second terminals, the first terminal coupled to the first power supply electrode and the second terminal coupled to the second input of the operational amplifier of the second amplifier circuit.

8. The reference voltage circuit of claim 6, wherein the second amplifier circuit further includes a second current mirror having a reference electrode and an output electrode, the reference electrode of the second current mirror of the second amplifier circuit coupled to the second input of the operational amplifier of the second amplifier circuit and the output electrode of the second current mirror of the second amplifier circuit coupled to the second current conductor of the first current mirror of the first amplifier circuit.

9. The reference voltage circuit of claim 8, wherein the first and second current mirrors are coupled to a second power supply electrode.

10. The reference voltage circuit of claim 2, wherein the second amplifier circuit includes an operational amplifier having first and second inputs and an output, the first input of the operational amplifier of the second amplifier circuit coupled to the cathode of the first diode connected transistor.

11. The reference voltage circuit of claim 1, wherein the summing circuit comprises a resistor.

12. A reference voltage circuit, comprising:

a first operational amplifier having first and second inputs and an output;

means for generating a first current having a positive temperature coefficient, the means for generating a first current having a first current conducting electrode coupled to the first input of the first operational amplifier, a second current conducting electrode coupled to the second input of the first operational amplifier, and a reference node;

a first current mirror having a control node, a reference current electrode, a feedback electrode, and an output, the reference current electrode and the feedback electrode coupled to the first and second inputs of the first operational amplifier, respectively, and the control node coupled to the output of the first operational amplifier;

a second operational amplifier having a first input, a second input, and an output, the second input of the second operational amplifier coupled to the reference node of the means for generating a first current;

means for generating a second current having a negative temperature coefficient, the means for generating a second current having a first current conducting electrode coupled to the first input of the second operational amplifier;

a second current mirror having a control node, a reference current electrode, and an output, the control node of the second current mirror coupled to the output of the second operational amplifier, and the output of the second current mirror coupled to the output of the first current mirror; and a summing circuit having a first electrode coupled to a first power supply electrode and a second electrode coupled to the outputs of the first and second current mirrors.

13. The reference voltage circuit of claim 12, wherein the first current mirror comprises a first plurality of transistors, each transistor of the first plurality of transistors having a control electrode and first and second current conducting electrodes, wherein the control electrodes of each transistor of the first plurality of transistors are commonly coupled to the output of the first operational amplifier to form the control node, the first current conducting electrodes of each transistor of the first plurality of transistors are coupled to a second power supply electrode, and wherein the second current conducting electrode of a first transistor of the first plurality of transistors forms the reference current electrode, the second electrode of a second transistor of the first plurality of transistors forms the feedback electrode, and the second electrode of a third transistor of the first plurality of transistors forms the output of the first current mirror.

14. The reference voltage circuit of claim 13, wherein the second current mirror comprises a second plurality of transistors, each transistor of the second plurality of transistors having a control electrode and first and second current conducting electrodes, wherein the control electrodes of each transistor of the second plurality of transistors are commonly coupled to the output of the second operational amplifier and form the control node, the first electrodes of each transistor of the second plurality of transistors coupled to the second power supply electrode, and wherein the second electrode of a first transistor of the second plurality of transistors is coupled to the first input of the second operational amplifier, and the second electrode of a second transistor of the second plurality of transistors is coupled to the second electrode of the third transistor of the first plurality of transistors.

15. The reference voltage circuit of claim 14, wherein the first power supply electrode is coupled to receive a first voltage and the second power supply electrode is coupled to receive a second voltage equal to approximately a sum of a base-to-emitter voltage and a drain-to-source voltage.

16. The reference voltage circuit of claim 13, wherein the first, second, and third transistors of the first plurality of transistors are field effect transistors, the first and second transistors of the first plurality of transistors having a same width-to-length ratio and the third transistor having a larger width-to-length ratio than the first and second transistors of the first plurality of transistors.

17. The reference voltage circuit of claim 12, wherein the means for generating a first current having a positive temperature coefficient comprises first and second transistors, each transistor having a control electrode and first and second current conducting electrodes, the first current conducting electrode of the first transistor of the means for generating a first current coupled to the first input of the first operational amplifier via a first resistor, the first current conducting electrode of the second transistor of the means for generating a first current coupled to the second input of the first operational amplifier, the second current conducting electrodes of the first and second transistors of the means for generating a first current coupled to each other and to the control electrodes of the first and second transistors of the means for generating a first current.

18. The reference voltage circuit of claim 17, wherein the means for generating a second current having a negative temperature coefficient comprises a second resistor and the first transistor of the means for generating a first current, wherein the first current conducting electrode of the first transistor of the means for generating a first current is coupled to the second input of the second operational amplifier, and the first input of the second operational amplifier is coupled to the second current conducting electrode of the first transistor of the means for generating a first current via the second resistor.

19. The reference voltage circuit of claim 17, wherein the first and second transistors of the means for generating a first current are bipolar transistors, the first transistor of the means for generating a first current having a larger emitter area than the second transistor of the means for generating a first current.

20. A method for generating an output voltage having a substantially zero temperature coefficient, comprising the steps of:

generating a first current having a positive temperature coefficient in accordance with a voltage difference across a set of p-n junctions;

generating a second current having a negative temperature coefficient in accordance with a voltage across a p-n junction of the set of p-n junctions;

summing the first and second currents to provide an output current having a substantially zero temperature coefficient; and using the output current to generate the output voltage.

21. The method for generating a voltage having a substantially zero temperature coefficient as claimed in claim 20, wherein the step of using the output current to generate the voltage includes setting a level of the voltage independently of setting the temperature coefficient of the voltage.

22. The method for generating a voltage having a substantially zero temperature coefficient as claimed in claim 20, wherein the step of generating a first current having a positive temperature coefficient includes operating two bipolar transistors at different current densities.

* * * * *